US009715245B2

(12) United States Patent
Yen et al.

(10) Patent No.: US 9,715,245 B2
(45) Date of Patent: Jul. 25, 2017

(54) CIRCUIT FOR GENERATING AN OUTPUT VOLTAGE AND METHOD FOR SETTING AN OUTPUT VOLTAGE OF A LOW DROPOUT REGULATOR

(71) Applicant: Taiwan Semiconductor Manufacturing Company Limited, Hsinchu (TW)

(72) Inventors: Chen-Lun Yen, Kaohsiung (TW); Gu-Huan Li, Hsinchu County (TW); Chung-Chieh Chen, Hsinchu (TW); Cheng-Hsiung Kuo, Hsinchu County (TW)

(73) Assignee: Taiwan Semiconductor Manufacturing Company Limited, Hsinchu (TW)

( * ) Notice: Subject to any disclaimer, the term of this patent is extended or adjusted under 35 U.S.C. 154(b) by 166 days.

(21) Appl. No.: 14/600,076

(22) Filed: Jan. 20, 2015

(65) Prior Publication Data

US 2016/0209854 A1 Jul. 21, 2016

(51) Int. Cl.

| | |
|---|---|
| ***G05F 1/10*** | (2006.01) |
| ***G05F 3/02*** | (2006.01) |
| ***G05F 1/575*** | (2006.01) |
| ***G05F 3/26*** | (2006.01) |

(52) U.S. Cl.

CPC ..... *G05F 1/575* (2013.01); *G05F 3/267* (2013.01)

(58) Field of Classification Search

CPC ..... G05F 1/465; G05F 3/262; G05F 3/247; G05F 3/24; G11C 5/147

USPC ..... 327/540, 541, 539

See application file for complete search history.

(56) References Cited

U.S. PATENT DOCUMENTS 4,608,530 A * 8/1986 Bacrania ..... G05F 3/262 323/315
6,160,393 A * 12/2000 Ahn ..... G05F 3/262 323/315
6,462,527 B1 * 10/2002 Maneatis ..... G05F 3/262 323/313

(Continued)

FOREIGN PATENT DOCUMENTS

KR 100803514 2/2008
KR 100803514 B1 * 2/2008

OTHER PUBLICATIONS

Chinese Office Action; Application No. 201510212033.7; dated Mar. 29, 2017.

*Primary Examiner* — Quan Tra
(74) *Attorney, Agent, or Firm* — Jones Day

(57) ABSTRACT

A circuit for generating an output voltage and method for setting an output voltage of a low dropout regulator are provided. A current source is configured to generate a reference current, and an error amplifier has a first input, a second input, and a single-ended output. The first input is connected to a reference voltage, and the second input is connected to an output node of the circuit via a feedback resistor. A pass transistor includes a control electrode connected to the single-ended output of the error amplifier, a first electrode connected to a power supply voltage, and a second electrode connected to the output node of the circuit. A first branch of a current mirror is connected to the current source, and a second branch of the current mirror is connected to the second terminal of the feedback resistor. The output node provides an output voltage of the circuit.

20 Claims, 5 Drawing Sheets

(56) References Cited

U.S. PATENT DOCUMENTS

| | | | | |
|---|---|---|---|---|
| 8,519,796 | B2 * | 8/2013 | Tanaka | G05F 3/262<br>323/315 |
| 8,531,235 | B1 * | 9/2013 | Zonte | G05F 3/30<br>327/512 |
| 2001/0011921 | A1 * | 8/2001 | Ooishi | G05F 1/465<br>327/540 |
| 2004/0017183 | A1 * | 1/2004 | Cho | G05F 3/242<br>323/313 |
| 2004/0253930 | A1 * | 12/2004 | Pan | G05F 3/30<br>455/73 |
| 2007/0194837 | A1 * | 8/2007 | Chiou | G05F 3/262<br>327/543 |
| 2009/0261801 | A1 * | 10/2009 | Jurasek | G05F 3/30<br>323/313 |
| 2010/0117619 | A1 * | 5/2010 | Kudo | G05F 3/262<br>323/315 |
| 2012/0094613 | A1 * | 4/2012 | Zhong | G05F 1/567<br>455/73 |
| 2012/0105047 | A1 * | 5/2012 | Huang | G05F 1/575<br>323/351 |
| 2012/0161742 | A1 * | 6/2012 | Huang | G11C 5/147<br>323/312 |

* cited by examiner

CIRCUIT FOR GENERATING AN OUTPUT VOLTAGE AND METHOD FOR SETTING AN OUTPUT VOLTAGE OF A LOW DROPOUT REGULATOR

BACKGROUND

Voltage regulators are used to provide a stable power supply voltage independent of load impedance, input voltage variations, temperature, and time. A low dropout (LDO) voltage regulator is a type of voltage regulator that can provide a low dropout voltage, i.e., a small input-to-output differential voltage, thus allowing the LDO regulator to maintain regulation with small differences between input voltage and output voltage. LDO regulators are used in a variety of applications in electronic devices to supply power. For example, LDO regulators are commonly used in battery-operated consumer devices. Thus, an LDO regulator may be used, for example, in a mobile device such as a smartphone to deliver a regulated voltage from a battery power supply to various components of the mobile device.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
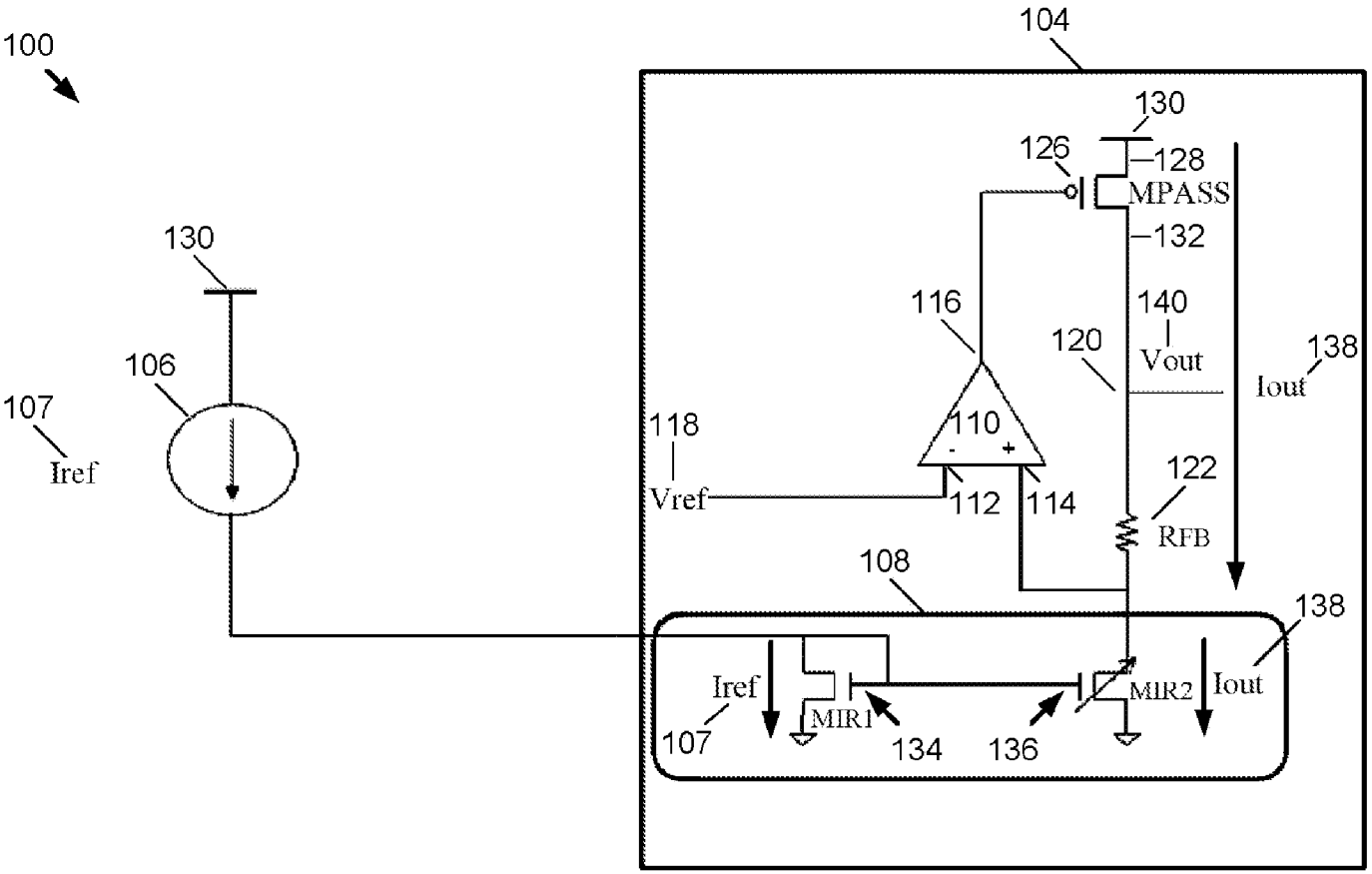
FIG. 1 depicts an example circuit for generating an output voltage, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an example circuit 100 for generating an output voltage 140, in accordance with some embodiments. The circuit 100 includes a current source 106 configured to generate a reference current $I_{REF}$ 107 and a low dropout (LDO) voltage regulator 104. As illustrated in FIG. 1, the LDO regulator 104 includes an error amplifier 110 (i.e., a differential amplifier) having a first input 112, a second input 114, and a single-ended output 116. The first input 112 is connected to a reference voltage $V_{REF}$ 118, and the reference voltage $V_{REF}$ 118 is a fixed voltage that is independent from process, voltage, and temperature (PVT) variation in the circuit 100.

In an example, the reference voltage $V_{REF}$ 118 is generated via a voltage-mode bandgap reference circuit that causes the reference voltage $V_{REF}$ 118 to be substantially constant and independent of PVT variation in the circuit 100. In other examples, the reference voltage $V_{REF}$ 118 is generated via a different circuit or component. The second input 114 of the error amplifier 110 is connected to an output node 120 of the circuit 100 via a feedback resistor $R_{FB}$ 122. The output node 120 provides the output voltage $V_{OUT}$ 140 of the low dropout regulator 104. As illustrated in FIG. 1, the feedback resistor $R_{FB}$ 122 includes a first terminal connected to the output node 120 and a second terminal connected to the second input 114 of the error amplifier 110.

The single-ended output 116 of the error amplifier 110 is coupled to a pass transistor MPASS of the low dropout regulator 104. The pass transistor MPASS, which may also be known as a power transistor, includes a control electrode 126 connected to the single-ended output 116 of the error amplifier 110, a first electrode 128 connected to a power supply voltage 130, and a second electrode 132 connected to the output node 120 of the LDO regulator 104. In the example of FIG. 1, the pass transistor MPASS is a p-type MOS transistor, such that the control node 126 is a gate terminal, the first electrode 128 is a source terminal, and the second electrode 132 is a drain terminal. It should be understood that the p-type MOS transistor illustrated in the example of FIG. 1 is exemplary only, and that in other examples, an n-type MOS transistor or another type of transistor is used as the pass transistor.

The output voltage $V_{OUT}$ 140 of the LDO regulator 104 is altered by adjusting parameters of a current mirror 108, where the current mirror 108 includes a first branch 134 and a second branch 136. The first branch 134 of the current mirror 108 is connected to the current source 106, and this connection causes the reference current $I_{REF}$ 107 to flow through the first branch 134, as illustrated in FIG. 1. The second branch 136 of the current mirror 108 is connected to the second terminal of the feedback resistor $R_{FB}$ 122.

The reference current $I_{REF}$ 107 is copied from the first branch 134 to the second branch 136, with the copying causing an output current $I_{OUT}$ 138 to flow through the second branch 136. The output current $I_{OUT}$ 138 that flows through the second branch 136 is based on the reference current $I_{REF}$ 107 flowing through the first branch 136 and a mirror ratio of the current mirror 108. The mirror ratio is a ratio between a current flowing through the first branch 134 (i.e., the reference current $I_{REF}$ 107 in the example of FIG. 1) and a current flowing through the second branch 136 (i.e., the output current $I_{OUT}$ 138 in the example of FIG. 1). The mirror ratio is based on physical dimensions of transistors included in the first and second branches 134, 136, and a number of transistors included in each of the first and second branches 134, 136, among other factors.

In the example of FIG. 1, the first branch 134 of the current mirror 108 includes a first NMOS transistor MIR1, and the second branch 136 includes a second NMOS transistor MIR2. It should be understood that the configuration of the current mirror 108 in FIG. 1 is an example only, and that in other examples, the current mirror 108 is implemented in a different manner. In FIG. 1, each of the branches 134, 136 includes a single transistor, such that if the first NMOS transistor MIR1 has same physical dimensions (e.g., transistor width, channel length, thicknesses, etc.) as the second NMOS transistor MIR2, the output current $I_{OUT}$ 138 that flows through the second branch 136 is equal to the reference current $I_{REF}$ 107 that flows through the first branch 134. In examples where the dimensions of the first NMOS transistor MIR1 differ from those of the second NMOS transistor MIR2, the output current $I_{OUT}$ 138 is different from the reference current $I_{REF}$ 107. For example, if the second NMOS transistor MIR2 has a width that is double that of the first NMOS transistor MIR1, then the output current $I_{OUT}$ 138 is double the reference current $I_{REF}$ 107.

No current or very little current flows into the second input 114 of the error amplifier 110. Consequently, the output current $I_{OUT}$ 138 that flows through the second branch 136 of the current mirror 108 also flows between source and drain terminals 128, 132 of the pass transistor MPASS and between the first and second terminals of the feedback resistor $R_{FB}$ 122, as illustrated in FIG. 1.

In the illustration of FIG. 1, the second NMOS transistor MIR2 of the second branch 136 is depicted with an arrow. The arrow denotes that one or more parameters of the second branch 136 are adjustable (i.e., tunable), and the adjusting of the one or more parameters is used to change the mirror ratio of the current mirror 108. In an example, one or more parameters of the second branch 136 are changed, and the changing of the one or more parameters changes the mirror ratio of the current mirror 108. For example, a switch may be used to adjust the mirror ratio of the current mirror 108, where closing the switch causes additional transistors to be coupled to the second branch 136 (i.e., thus causing the output current $I_{OUT}$ 138 to increase), and opening the switch causes the additional transistors to be de-coupled from the second branch 136 (i.e., thus causing the output current $I_{OUT}$ 138 to decrease). An example illustrating the use of such a switch is described below with reference to FIG. 2.

Although the example of FIG. 1 depicts the second branch 136 as being adjustable, it should be appreciated that in general, the current mirror 108 is an adjustable current mirror including one or more parameters that can be adjusted to vary the mirror ratio. Thus, in an example, parameters of the first branch 134 are adjustable to change the mirror ratio of the current mirror 108. In another example, parameters of both the first and second branches 134, 136 are adjustable to change the mirror ratio of the current mirror 108.

By adjusting the mirror ratio of the current mirror 108, the output voltage $V_{OUT}$ 140 of the LDO regulator 104 is altered. The output voltage $V_{OUT}$ 140 is given by Equation 1:

$$V_{OUT}=V_{REF}+(R_{FB}*I_{OUT}), \quad \text{(Equation 1)}$$

where $V_{OUT}$ is the output voltage 140, $V_{REF}$ is the reference voltage 118, $R_{FB}$ is the resistance of the feedback resistor 122, and $I_{OUT}$ is the output current 138 illustrated in FIG. 1. As explained above, the output current $I_{OUT}$ 138 that flows through the second branch 136 and between the first and second terminals of the feedback resistor $R_{FB}$ 122 is based on the mirror ratio of the current mirror 108. Thus, by adjusting the one or more parameters of the adjustable current mirror 108 as described above, the output current $I_{OUT}$ 138 is changed, and consequently, the output voltage $V_{OUT}$ 140 of the LDO regulator 104 is also changed. The output voltage $V_{OUT}$ 140 of the LDO regulator 104 is precisely altered by changing the mirror ratio of the current mirror 108. The altering of the output voltage $V_{OUT}$ 140 in this manner is described in further detail below with reference to FIGS. 2 and 5.

As noted above, the circuit 100 for generating the output voltage $V_{OUT}$ 140 includes the current source 106 that is configured to generate the reference current $I_{REF}$ 107. The current source 106 is connected to the power supply voltage 130 and provides the reference current $I_{REF}$ 107 to the first branch 134 of the current mirror 108. The reference current $I_{REF}$ 107 generated by the current source 106 is independent of supply voltage variation in the circuit 100, and in an example, the current source 106 is a current-mode bandgap reference circuit. In other examples, the current source 106 is not a current-mode bandgap reference circuit.

Although the reference current $I_{REF}$ 107 generated by the current source 106 is generally a constant current (e.g., the reference current $I_{REF}$ 107 is constant with respect to changes in supply voltage in the circuit 100, as described above), the reference current $I_{REF}$ 107 changes based on variation of the resistance of the feedback resistor $R_{FB}$ 122. The current source 106 and the reference current $I_{REF}$ 107 are thus said to have a "resistor-tracking capability," such that when changes in the resistance of the feedback resistor $R_{FB}$ 122 occur, the reference current $I_{REF}$ 107 also changes. Specifically, the reference current $I_{REF}$ 107 increases with decreases in the resistance of the feedback resistor $R_{FB}$ 122, and the reference current 107 decreases with increases in the resistance of the feedback resistor $R_{FB}$ 122. The reference current $I_{REF}$ 107 thus has a negative relationship with respect to the resistance of the feedback resistor $R_{FB}$ 122.

The resistor-tracking capability of the current source 106 and the reference current $I_{REF}$ 107 ensures that the output voltage $V_{OUT}$ 140 of the LDO regulator 104 stays substantially constant despite process, voltage, and/or temperature variation in the circuit 100. To illustrate this, Equation 1 is rewritten in terms of the reference current $I_{REF}$ 107:

$$V_{OUT}=V_{REF}+(R_{FB}*\alpha_1*I_{REF}), \quad \text{(Equation 2)}$$

where $V_{OUT}$ is the output voltage 140, $V_{REF}$ is the reference voltage 118, $R_{FB}$ is the resistance of the feedback resistor 122, $I_{REF}$ is the reference current 107, and $\alpha_1$ is the mirror ratio of the current mirror 108, such that $\alpha_1$ is equal to $(I_{OUT}/I_{REF})$. As noted above, when changes in the resistance of the feedback resistor $R_{FB}$ 122 occur, the reference current $I_{REF}$ 107 also changes, with the reference current $I_{REF}$ 107 increasing with decreases in the resistance of the feedback resistor $R_{FB}$ 122, and the reference current $I_{REF}$ 107 decreasing with increases in the resistance of the feedback resistor $R_{FB}$ 122. The feedback resistor $R_{FB}$ 122 is made of process- and temperature-dependent material, and thus, the changes in the resistance of the feedback resistor $R_{FB}$ 122 are due to process and temperature variation in the circuit 100. The reference current $I_{REF}$ 107 is configured to track the changes in the feedback resistor $R_{FB}$ 122, such that the output voltage $V_{OUT}$ 140 is substantially constant despite process, voltage, and/or temperature variation in the circuit 100. Thus, with reference to Equation 2, as the resistance of the feedback resistor $R_{FB}$ 122 increases, for example, the reference current $I_{REF}$ 107 decreases a corresponding amount that causes the output voltage $V_{OUT}$ 140 to be substantially constant.

In conventional LDO regulators that do not employ the adjustable current mirror 108, one or more transmission gates may be used to adjust the output voltage of the LDO regulator. The use of such transmission gates in LDO regulators is associated with various problems (e.g., blocking certain output voltages, etc.), and thus, the circuit 100, which does not include a transmission gate, remedies one or more of the problems inherent in the conventional LDO regulators. Additionally, the circuit 100 of FIG. 1 exhibits minimum PVT corner variation, and this is enabled, at least in part, by (i) the use of the reference voltage $V_{REF}$ 118 that is a constant voltage, independent from process, voltage, and temperature variation in the circuit 100, and (ii) the use of the resistor-tracking in the current source 106, which mitigates an effect of changes in the resistance of the feedback resistor $R_{FB}$ 122 on the output voltage $V_{OUT}$ 140, as explained above with reference to Equation 2.

Figure 2:
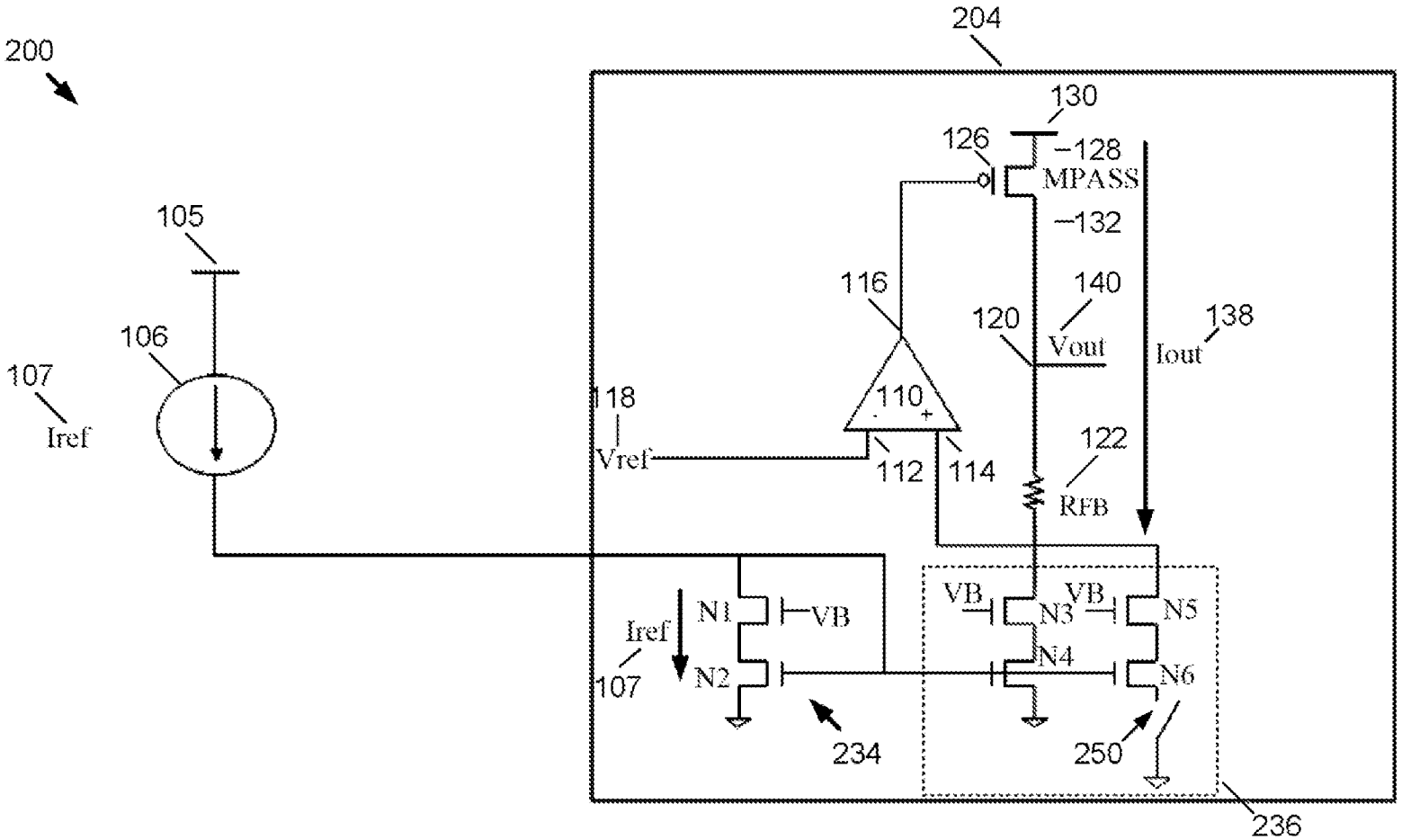
FIG. 2 depicts an example circuit that includes an adjustable cascode current mirror, in accordance with some embodiments.
Figure 3:
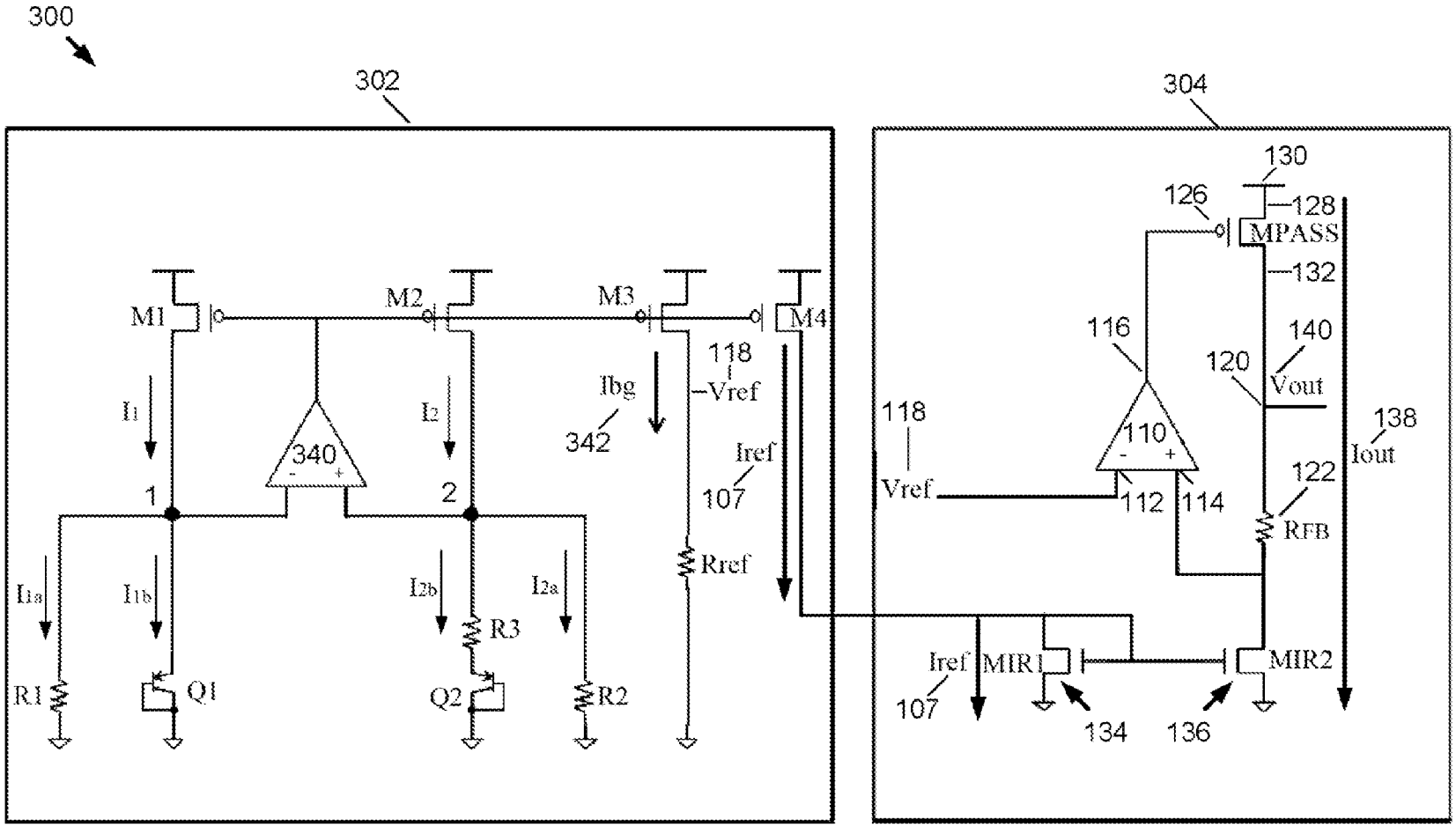
FIG. 3 depicts an example circuit including a current-mode bandgap reference circuit, in accordance with some embodiments.
Figure 4:
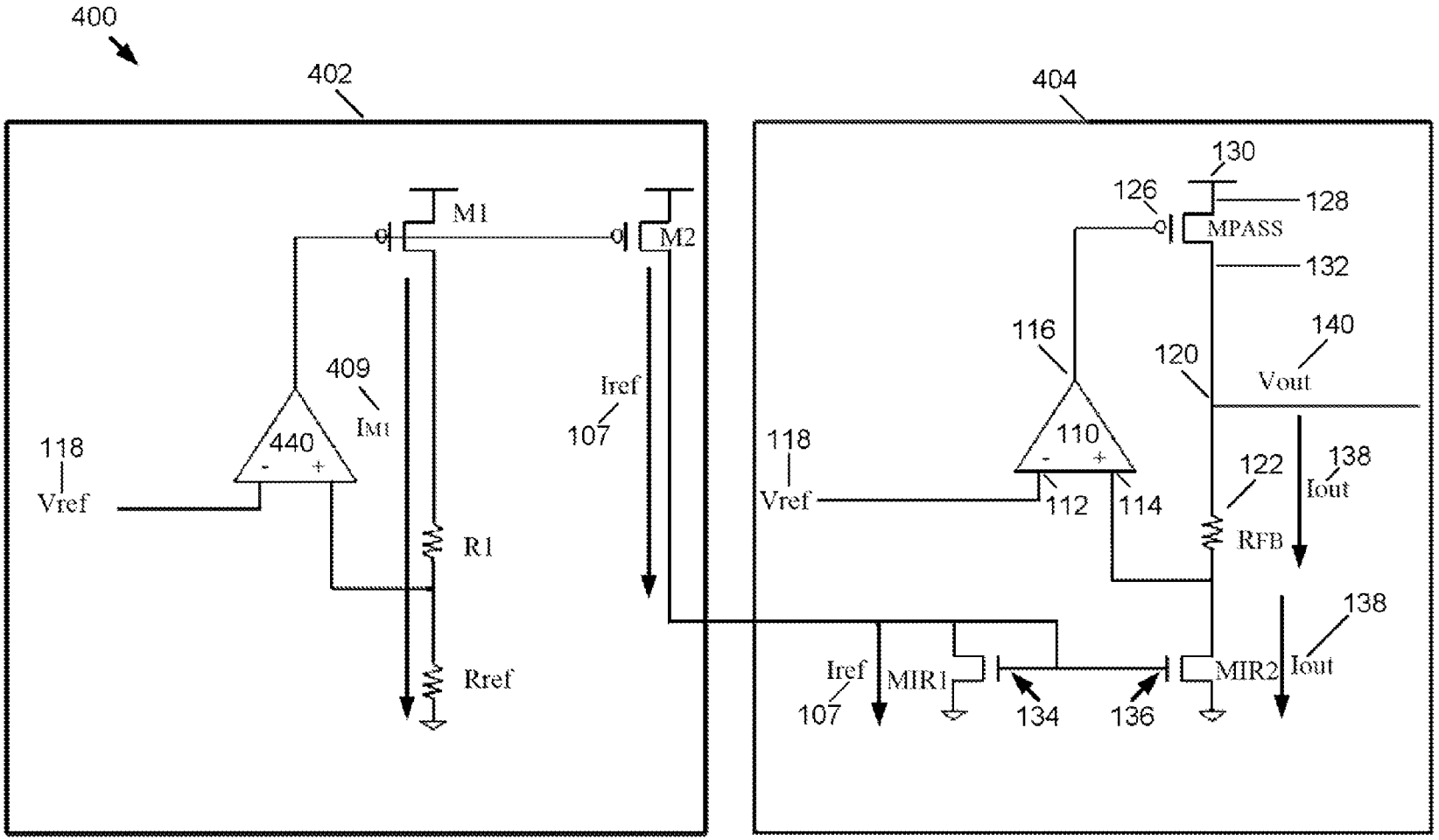
FIG. 4 depicts an example circuit for generating an output voltage, where the circuit does not utilize a current-mode bandgap reference circuit, in accordance with some embodiments.

FIGS. 2-4, described in detail below, include components that are the same as or substantially similar to components included in the circuit 100 of FIG. 1. In FIGS. 2-4, such components are labeled with the same reference numerals as used in FIG. 1. For brevity, the description of these components is not repeated in detail below.

FIG. 2 depicts an example circuit 200 that includes an adjustable cascode current mirror, in accordance with some embodiments. As described above with reference to FIG. 1, the circuit for generating an output voltage described herein includes an adjustable current mirror. By adjusting one or more parameters of the adjustable current mirror, a mirror ratio of the current mirror is changed, and consequently, the output voltage of an LDO regulator is altered. FIG. 2 illustrates an example of the adjustable current mirror that includes a switch 250. The switch 250 is used in adjusting the mirror ratio of the current mirror, where opening the switch 250 causes the current mirror to have a first mirror ratio, and closing the switch 250 causes the current mirror to have a second mirror ratio. When the mirror ratio is changed between the first and second mirror ratios via the opening and closing of the switch 250, the output voltage $V_{OUT}$ 140 of the LDO regulator 204 changes correspondingly.

The adjustable current mirror of FIG. 2 includes a first branch 234 and a second branch 236. The first branch 234 of the current mirror includes a first NMOS transistor N1 having a drain terminal connected to the current source 106, and a gate terminal connected to a bias voltage (i.e., labeled "VB" in FIG. 2). The first branch 234 further includes a second NMOS transistor N2 having a drain terminal connected to a source terminal of the first NMOS transistor N1, and a source terminal connected to a ground reference voltage.

The second branch 236 of the current mirror includes a third NMOS transistor N3 having a drain terminal connected to the second terminal of the feedback resistor $R_{FB}$ 122, and a gate terminal connected to the bias voltage. A fourth NMOS transistor N4 of the second branch 236 has a drain terminal connected to a source terminal of the third NMOS transistor N3, a gate terminal connected to a gate terminal of the second NMOS transistor N2, and a source terminal connected to the ground reference voltage. The second branch 236 further comprises a fifth NMOS transistor N5 having a drain terminal connected to the second terminal of the feedback resistor $R_{FB}$ 122, and a gate terminal connected to the bias voltage. A sixth NMOS transistor N6 of the second branch 236 has a drain terminal connected to a source terminal of the fifth NMOS transistor N5, a gate terminal connected to the gate terminal of the second NMOS transistor N2, and a source terminal connected to the ground reference voltage via the switch 250.

As illustrated in FIG. 2, the current mirror is adjustable through the use of the switch 250, which allows the source of the sixth NMOS transistor N6 to be coupled to and decoupled from the ground reference voltage. When the switch 250 is open, no current flows through the fifth and sixth transistors N5, N6. If the third and fourth NMOS transistors N3, N4 have physical dimensions that are the same as those of the first and second NMOS transistors N1, N2, respectively, then the output current $I_{OUT}$ 138 is equal to the reference current $I_{REF}$ 107 generated by the current source 106. Consequently, the output voltage 140 of the LDO regulator 204 in this scenario is equal to:

$$V_{OUT}=V_{REF}+(R_{FB}*I_{REF}), \quad \text{(Equation 3)}$$

where $V_{OUT}$ is the output voltage 140, $V_{REF}$ is the reference voltage 118, $R_{FB}$ is the resistance of the feedback resistor 122, and $I_{REF}$ is the reference current 107.

By contrast, when the switch 250 is closed, current flows through the fifth and sixth NMOS transistors N5, N6. If the third and fourth NMOS transistors N3, N4 have physical dimensions that are the same as those of the first and second NMOS transistors N1, N2, respectively, and if the fifth and sixth NMOS transistors N5, N6 have physical dimensions that are the same as those of the first and second NMOS transistors N1, N2, respectively, then the output current $I_{OUT}$ 138 is equal to double the reference current $I_{REF}$ 107. Consequently, the output voltage 140 of the LDO regulator 204 in this scenario is equal to:

$$V_{OUT}=V_{REF}+(R_{FB}*2*I_{REF}) \quad \text{(Equation 4)}$$

In these scenarios, the mirror ratio of the current mirror is equal to "1" when the switch is open and equal to "2" when the switch is closed. The example of FIG. 2 thus illustrates the adjusting of one or more parameters of the current mirror, where the adjusting of the one or more parameters changes both the mirror ratio of the current mirror and the output voltage of the LDO regulator 204. It should be appreciated that the current mirror and mechanism for adjusting the mirror ratio (i.e., the switch 250) of FIG. 2 are examples only. In other examples, the current mirror is implemented using different types of transistors and/or other components, and the mechanism for adjusting the mirror ratio does not utilize a switch. In general, any mechanism that can be used to adjust an amount of current flowing through the first or second branch of the current mirror relative to the amount of current flowing in the other branch is an adequate mechanism for adjusting the mirror ratio. In certain examples, the adjusting of the mirror ratio is performed by changing physical dimensions of transistors included in the first or second branch and/or changing a number of transistors that carry current in the first or second branch.

FIG. 3 depicts an example circuit 300 including a current-mode bandgap reference circuit 302, in accordance with some embodiments. As described above with reference to FIG. 1, in certain examples, the circuit for generating an output voltage described herein uses a current-mode bandgap reference circuit in implementing the current source 106. Thus, in these examples, the reference current $I_{REF}$ 107 is generated by the current-mode bandgap reference circuit and is substantially constant despite variation in supply voltage in the circuit. FIG. 3 illustrates an example current-mode bandgap reference circuit 302 used in the circuit disclosed herein to generate the reference current $I_{REF}$ 107.

The current-mode bandgap reference circuit 302 includes a complementary metal-oxide-semiconductor (CMOS) operational amplifier 340 including a first input, a second input, and a single-ended output. A first resistor R1 has a first terminal connected to a ground reference voltage, and a second terminal connected to the first input of the CMOS operational amplifier 340. A second resistor R2 included in the current-mode bandgap reference circuit 302 has a first terminal connected to the ground reference voltage, and a second terminal connected to the second input of the CMOS operational amplifier 340.

A first bipolar junction transistor Q1 included in the current-mode bandgap reference circuit 302 has an emitter terminal connected to the first input of the CMOS operational amplifier 340, a collector terminal connected to the ground reference voltage, and a base terminal connected to the collector terminal of the first bipolar junction transistor Q1. A second bipolar junction transistor Q2 has a collector terminal connected to the ground reference voltage, and a base terminal connected to the collector terminal of the second bipolar junction transistor Q2. A third resistor R3 included in the current-mode bandgap reference circuit 302 has a first terminal connected to an emitter terminal of the second bipolar junction transistor Q2, and a second terminal connected to the second input of the CMOS operational amplifier 340.

The current-mode bandgap reference circuit 302 also includes a first PMOS transistor M1 including a source terminal connected to the power supply voltage, a drain terminal connected to the first input of the CMOS operational amplifier 340, and a gate terminal connected to the single-ended output of the CMOS operational amplifier 340. A second PMOS transistor M2 includes a source terminal connected to the power supply voltage, a drain terminal connected to the second input of the CMOS operational amplifier 340, and a gate terminal connected to the single-ended output of the CMOS operational amplifier 340. A third PMOS transistor M3 included in the current-mode bandgap reference circuit 302 includes a source terminal connected to the power supply voltage, and a gate terminal connected to the gate terminal of the second PMOS transistor M2.

The current-mode bandgap reference circuit 302 also includes a reference resistor $R_{REF}$ having a first terminal connected to a drain terminal of the third PMOS transistor M3, and a second terminal connected to the ground reference voltage. A bandgap current $I_{BG}$ 342 generated by the current-mode bandgap reference circuit 302 flows between the source and drain terminals of the third PMOS transistor M3 and through the reference resistor $R_{REF}$. The bandgap current $I_{BG}$ 342 does not change with variations in the supply voltage in the circuit 300.

To generate the bandgap current $I_{BG}$ 342, it is assumed that the operational amplifier 340 is ideal with infinite DC gain and zero offset voltage. The first, second, and third NMOS transistors M1, M2, M3 are matched, and R1 equals R2. As a result, node voltages $V_1$ and $V_2$ are equal, current $I_1$ is equal to current $I_2$, and $I_{1a}=I_{2a}$, $I_{1b}=I_{2b}$. Two types of currents, $I_{1a}$ ($I_{2a}$) and $I_{2b}$ ($I_{1b}$), are generated in the circuit 302. First, $I_{1a}$ ($I_{2a}$) is a current proportional to $V_{BE}$ of the first bipolar junction transistor Q1 and has a negative temperature coefficient. Second, $I_{2b}$ ($I_{1b}$) is a proportional to absolute temperature (PTAT) current generated based on the third resistor R3 and $\Delta V_{BE}$ of the first and second bipolar junction transistors Q1 and Q2. The PTAT current has a positive temperature coefficient and thus increases with increasing temperature. Using appropriate parameter values, compensation of the temperature dependence of the current $I_1$ ($I_2$) is achieved, with the temperature-compensated output current being the bandgap current $I_{BG}$ 342. As illustrated in the example of FIG. 3, the reference voltage $V_{REF}$ 118 is formed by passing the bandgap current $I_{BG}$ 342 through the reference resistor $R_{REF}$, such that the bandgap current $I_{BG}$ 342 is equal to ($V_{REF}/R_{REF}$).

Although the generation of the bandgap current $I_{BG}$ 342 eliminates some temperature dependence in the bandgap current $I_{BG}$ 342 for the reasons described above, it should be appreciated that this current 342 nevertheless has a temperature-dependence due to its relationship with the reference resistor $R_{REF}$. As indicated above, the bandgap current $I_{BG}$ 342 is equal to ($V_{REF}/R_{REF}$). Although the reference voltage $V_{REF}$ 118 is a constant voltage that is independent of PVT variation, the resistor $R_{REF}$ is made of process- and temperature-dependent material. Because the bandgap current $I_{BG}$ 342 is a function of the process- and temperature-dependent resistor $R_{REF}$, the bandgap current $I_{BG}$ 342 exhibits process and temperature dependencies. As noted above, the bandgap current $I_{BG}$ 342 is independent of supply voltage variation in the circuit 300.

A fourth PMOS transistor M4 includes a source terminal connected to the power supply voltage, a gate terminal connected to the gate terminal of the third PMOS transistor M3, and a drain terminal connected to the first branch 134 of the current mirror. The third and fourth transistors M3 and M4 implement a second current mirror, such that the reference current $I_{REF}$ 107 provided to the first branch 134 is equal to the bandgap current $I_{BG}$ 342 multiplied by a mirror ratio of the second current mirror i.e., $I_{REF}=\alpha_2*I_{BG}$, where $\alpha_2$ is the mirror ratio of the second current mirror implemented by the transistors M3 and M4.

As explained above, the bandgap current $I_{BG}$ 342 is independent of supply voltage variation but exhibits process and temperature dependencies, due to the relationship of the current 342 with the process- and temperature-dependent resistor $R_{REF}$. Because the reference current $I_{REF}$ 107 is based on the bandgap current $I_{BG}$ 342 (i.e., $I_{REF}=\alpha_2*I_{BG}$), the reference current $I_{REF}$ 107 varies based on process and temperature variation in the circuit 300. Further, the reference current $I_{REF}$ 107 exhibits the resistor-tracking capability of the bandgap current $I_{BG}$ 342 due to the relationship between the currents 107, 342. The resistor-tracking capability of the bandgap current $I_{BG}$ 342 is based on the reference resistor $R_{REF}$ included in the circuit 302. The bandgap current $I_{BG}$ 342 is inversely proportional to the resistance of the reference resistor $R_{REF}$, with $I_{BG}=(V_{REF}/R_{REF})$. The reference resistor $R_{REF}$ of the current-mode bandgap reference circuit 302 and the feedback resistor $R_{FB}$ 122 of the LDO regulator 304 are formed of a same material on a single substrate, such that the feedback resistor $R_{FB}$ 122 and the reference resistor $R_{REF}$ have similar electrical properties under process, voltage, and temperature (PVT) variation. Consequently, the resistance of the reference resistor $R_{REF}$ tracks changes in the resistance of the feedback resistor $R_{FB}$ 122, with the resistance of the resistor $R_{REF}$ increasing with increases in the resistance of the feedback resistor $R_{FB}$ 122, and the resistance of the resistor $R_{REF}$ decreasing with decreases in the resistance of the feedback resistor $R_{FB}$ 122.

The bandgap current $I_{BG}$ 342 tracks changes in the resistance of the feedback resistor $R_{FB}$ 122 based on changes in the resistance $R_{REF}$ (i.e., due to $I_{BG}=V_{REF}/R_{REF}$), such that the bandgap current $I_{BG}$ 342 (i) increases with decreases in the resistance of the feedback resistor $R_{FB}$ 122, and (ii) decreases with increases in the resistance of the feedback resistor $R_{FB}$ 122. Because the reference current $I_{REF}$ 107 is based on the bandgap current $I_{BG}$ 342 (i.e., $I_{REF}=\alpha_2*I_{BG}$), the reference current $I_{REF}$ 107 also (i) increases with decreases in the resistance of the feedback resistor $R_{FB}$ 122, and (ii) decreases with increases in the resistance of the feedback resistor $R_{FB}$ 122. The reference current $I_{REF}$ 107 is thus said to have a resistor-tracking capability.

The resistor-tracking capability of the reference current $I_{REF}$ 107 ensures that the output voltage $V_{OUT}$ 140 of the LDO regulator 304 stays substantially constant despite process, voltage, and/or temperature variation in the circuit 300. To illustrate this, Equation 1 is rewritten in terms of the reference resistor $R_{REF}$:

$$I_{OUT} = \alpha_1 * I_{REF}, \quad \text{(Equation 5)}$$

$$I_{REF} = \alpha_2 * I_{BG}, \quad \text{(Equation 6)}$$

$$I_{BG} = \frac{V_{REF}}{R_{REF}}, \quad \text{(Equation 7)}$$

$$V_{OUT} = V_{REF} + \left(R_{FB} * \alpha_1 * \alpha_2 * \frac{V_{REF}}{R_{REF}}\right), \quad \text{(Equation 8)}$$

where $V_{OUT}$ is the output voltage 140, $V_{REF}$ is the reference voltage 118, $R_{FB}$ is the resistance of the feedback resistor 122, $I_{REF}$ is the reference current 107, $\alpha_1$ is the mirror ratio of the current mirror formed between branches 134 and 136, and $\alpha_2$ is the mirror ratio of the second current mirror implemented by the transistors M3 and M4.

As noted above, when changes in the resistance of the feedback resistor $R_{FB}$ 122 occur, the resistance of the reference resistor $R_{REF}$ also changes, with the resistance of the reference resistor $R_{REF}$ having a positive relationship with respect to the resistance of the feedback resistor $R_{FB}$ 122. With the reference resistor $R_{REF}$ tracking the feedback resistor $R_{FB}$ 122 in this manner, and with the reference voltage $V_{REF}$ 118 being independent of PVT variation, the output voltage $V_{OUT}$ 140 is substantially constant despite any process, voltage, or temperature variation in the circuit 300. With reference to Equation 8, as the resistance of the feedback resistor $R_{FB}$ 122 increases, for example, the resistance of the reference resistor $R_{REF}$ increases a corresponding amount that causes the output voltage $V_{OUT}$ 140 to be substantially constant.

FIG. 4 depicts an example circuit 400 for generating an output voltage, where the circuit 400 does not utilize a current-mode bandgap reference circuit, in accordance with some embodiments. As described above with reference to FIG. 1, in certain examples, the circuit for generating an output voltage described herein does not use a current-mode bandgap reference circuit in implementing the current source 106. Thus, in these examples, the reference current $I_{REF}$ 107 is generated based on the reference voltage $V_{REF}$ 118 that is a constant voltage, independent of PVT variation. In an example, the reference voltage $V_{REF}$ 118 is generated using a voltage-mode bandgap reference circuit. In other examples, the reference voltage $V_{REF}$ 118 is generated using a different circuit or component. FIG. 4 illustrates an example current source 402 that is not a current-mode bandgap reference circuit and that utilizes the reference voltage $V_{REF}$ 118 in generating the reference current $I_{REF}$ 107.

The current source 402 includes a complementary metal-oxide-semiconductor (CMOS) operational amplifier 440 including a first input, a second input, and a single-ended output. The first input of the CMOS operational amplifier 440 is connected to the reference voltage $V_{REF}$ 118. A first PMOS transistor M1 has a source terminal connected to the power supply voltage, and a gate terminal connected to the single-ended output of the CMOS operational amplifier 440. A first resistor R1 has a first terminal connected to a drain terminal of the first PMOS transistor M1, and a second terminal connected to the second input of the CMOS operational amplifier 440.

A reference resistor $R_{REF}$ included in the current source 402 has a first terminal connected to the second terminal of the first resistor R1, and a second terminal connected to a ground reference voltage. A second PMOS transistor M2 has a source terminal connected to the power supply voltage, a gate terminal connected to the gate terminal of the first PMOS transistor M1, and a drain terminal connected to the first branch 134 of the current mirror.

As explained above, the current mirror formed between the branches 134 and 136 can be implemented in various different ways. In the example of FIG. 4, the first branch 134 of the current mirror includes a first NMOS transistor MIR1. The first NMOS transistor MIR1 includes a drain terminal connected to the drain terminal of the second PMOS transistor M2, a source terminal connected to the ground reference voltage, and a gate terminal connected to the drain terminal of the first NMOS transistor MIR1. The second branch 136 of the current mirror includes a second NMOS transistor MIR2. The second NMOS transistor MIR2 includes a source terminal connected to the ground reference voltage, a gate terminal connected to the gate terminal of the first NMOS transistor MIR1, and a drain terminal connected to the second terminal of the feedback resistor $R_{FB}$ 122.

A current $I_{M1}$ 409 that flows between source and drain terminals of the first PMOS transistor M1 and through the resistors $R_1$ and $R_{REF}$ is equal to ($V_{REF}/R_{REF}$). Although the reference voltage $V_{REF}$ 118 is a constant voltage that is independent of PVT variation, the resistor $R_{REF}$ is made of process- and temperature-dependent material. Because the current $I_{M1}$ 409 is a function of the process- and temperature-dependent resistor $R_{REF}$, the current $I_{M1}$ 409 exhibits process and temperature dependencies.

The first and second PMOS transistors M1 and M2 implement a second current mirror, such that the reference current $I_{REF}$ 107 provided to the first branch 134 is equal to the current $I_{M1}$ 409 multiplied by a mirror ratio of the second current mirror i.e., $I_{REF}=\alpha_3*I_{M1}$, where $\alpha_3$ is the mirror ratio of the second current mirror implemented by the transistors M1 and M2. As explained above, the current $I_{M1}$ 409 exhibits process and temperature dependencies, due to its relationship with the process- and temperature-dependent resistor $R_{REF}$ (i.e., $I_{M1}=V_{REF}/R_{REF}$). Because the reference current $I_{REF}$ 107 is based on the current $I_{M1}$ 409, the reference current $I_{REF}$ 107 also exhibits the process and temperature dependencies. Specifically, in the example of FIG. 4, the reference current $I_{REF}$ 107 is equal to $$I_{REF} = \alpha_3 * \frac{V_{REF}}{R_{REF}}. \quad \text{(Equation 9)}$$

Based on Equation 9, it should be appreciated that the reference current $I_{REF}$ 107 exhibits a resistor-tracking capability and that this resistor-tracking capability enables the output voltage $V_{OUT}$ 140 to be substantially constant despite process, voltage, and/or temperature variation in the circuit 400. The resistance of the reference resistor $R_{REF}$ tracks changes in the resistance of the feedback resistor $R_{FB}$ 122, and this causes the reference current $I_{REF}$ 107 to have a negative relationship with respect to the resistance of the feedback resistor $R_{FB}$ 122. For reasons similar to those explained above with reference to FIG. 3, this resistor-tracking capability of the reference current $I_{REF}$ 107 causes the output voltage $V_{OUT}$ 140 of the LDO regulator 404 to stay substantially constant despite process, voltage, and/or temperature variation in the circuit 400.

Figure 5:
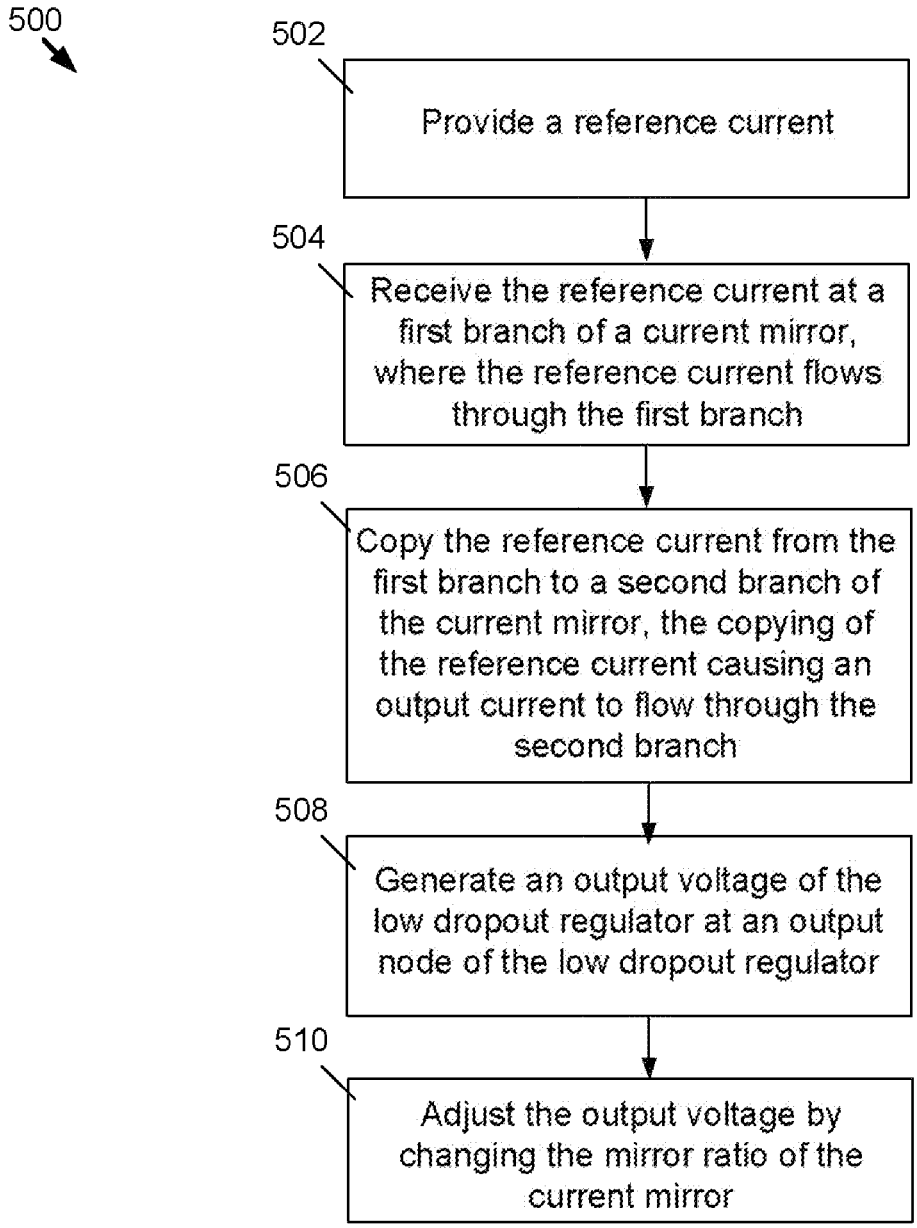
FIG. 5 is a flow diagram depicting example steps of a method for setting an output voltage of a low dropout regulator, in accordance with some embodiments.

FIG. 5 is a flow diagram 500 depicting example steps of a method for setting an output voltage of a low dropout regulator, in accordance with some embodiments. At 502, a reference current is provided. At 504, the reference current is received at a first branch of a current mirror, where the reference current flows through the first branch. At 506, the reference current is copied from the first branch to a second branch of the current mirror. The copying of the reference current causes an output current to flow through the second branch, where the output current is based on the reference current flowing through the first branch and a mirror ratio of the current mirror. At 508, an output voltage of the low dropout regulator is generated at an output node, the output node being connected to a first terminal of a feedback resistor. A second terminal of the feedback resistor is connected to (i) a first input of an error amplifier of the low dropout regulator, and (ii) the second branch of the current mirror. A second input of the error amplifier is connected to a reference voltage. At 510, the output voltage is adjusted by changing the mirror ratio of the current mirror.

The present disclosure is directed to a circuit for generating an output voltage and a method for setting an output voltage of an LDO regulator. As described above, the circuit for generating the output voltage utilizes an adjustable current mirror for altering the output voltage of the LDO regulator. By changing a mirror ratio of the current mirror, the output voltage of the LDO regulator is precisely altered. The circuit for generating the output voltage does not utilize a transmission gate to alter the output voltage, thus avoiding problems associated with conventional LDO regulators. The circuit for generating the output voltage also utilizes a current source with a resistor-tracking capability. Specifically, a reference current generated by the current source tracks variation in resistance values of one or more resistors included in the circuit, and this resistor-tracking capability causes the output voltage of the LDO regulator to be substantially constant despite process, voltage, and/or temperature variation in the circuit.

In an embodiment of a circuit for generating an output voltage, the circuit includes a current source configured to generate a reference current and an error amplifier having a first input, a second input, and a single-ended output. The first input is connected to a reference voltage, and the second input is connected to an output node of the circuit via a feedback resistor. The feedback resistor includes a first terminal connected to the output node and a second terminal connected to the second input. The circuit also includes a pass transistor including a control electrode connected to the single-ended output of the error amplifier, a first electrode connected to a power supply voltage, and a second electrode connected to the output node of the circuit. A first branch of a current mirror is connected to the current source, and the reference current flows through the first branch. A second branch of the current mirror is connected to the second terminal of the feedback resistor. An output current that flows through the second branch and between the first and second terminals of the feedback resistor is based on (i) the reference current flowing through the first branch, and (ii) a mirror ratio of the current mirror. The output node provides an output voltage of the circuit.

Another embodiment of a circuit for generating an output voltage includes a current-mode bandgap reference circuit configured to generate a reference current. The circuit also includes an error amplifier having a first input, a second input, and a single-ended output. The first input is connected to a reference voltage, and the second input is connected to an output node of the circuit via a feedback resistor, the feedback resistor including a first terminal connected to the output node and a second terminal connected to the second input. The circuit also includes a pass transistor including a control electrode connected to the single-ended output of the error amplifier, a first electrode connected to the power supply voltage, and a second electrode connected to the output node of the circuit. The circuit further includes a current mirror. The current mirror includes a first NMOS transistor including a source terminal connected to a ground reference voltage, a gate terminal connected to a drain terminal of the first NMOS transistor, and the drain terminal connected to the current-mode bandgap reference circuit. The reference current flows between the drain and source terminals of the first NMOS transistor. The current mirror also includes a second NMOS transistor having a source terminal connected to the ground reference voltage, a gate terminal connected to the gate terminal of the first NMOS transistor, and a drain terminal connected to the second terminal of the feedback resistor. An output current flows between the drain and source terminals of the second NMOS transistor is based on the reference current and a mirror ratio of the current mirror. The output node provides an output voltage of the circuit.

In an embodiment of a method for setting an output voltage of a low dropout regulator, a reference current is provided. The reference current is received at a first branch of a current mirror, where the reference current flows through the first branch. The reference current is copied from the first branch to a second branch of the current mirror. The copying of the reference current causes an output current to flow through the second branch, where the output current is based on the reference current flowing through the first branch and a mirror ratio of the current mirror. An output voltage of the low dropout regulator is generated at an output node, the output node being connected to a first terminal of a feedback resistor. A second terminal of the feedback resistor is connected to (i) a first input of an error amplifier of the low dropout regulator, and (ii) the second branch of the current mirror. A second input of the error amplifier is connected to a reference voltage. The output voltage is adjusted by changing the mirror ratio of the current mirror.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A circuit for generating an output voltage that is substantially constant despite process, voltage, or temperature variation in the circuit, the circuit comprising:

an error amplifier having a first input, a second input, and a single-ended output, wherein the first input is electrically connected to a reference voltage, and the second input is electrically connected to an output node of the circuit via a feedback resistor, the feedback resistor including a first terminal electrically connected to the output node and a second terminal electrically connected to the second input;

a pass transistor including a control electrode electrically connected to the single-ended output of the error amplifier, a first electrode electrically connected to a power supply voltage, and a second electrode electrically connected to the output node of the circuit;

a current source configured to generate a reference current that changes when a resistance of the feedback resistor changes;

a first branch of a current mirror electrically connected to the current source, the reference current flowing through the first branch; and a second branch of the current mirror electrically connected to the second terminal of the feedback resistor, wherein an output current that flows through the second branch and between the first and second terminals of the feedback resistor is based on (i) the reference current flowing through the first branch, and (ii) a mirror ratio of the current mirror, wherein the output node provides an output voltage of the circuit, and the current source includes:

a complementary metal-oxide-semiconductor (CMOS) operational amplifier including a first input, a second input, and a single-ended output, wherein the first input of the CMOS operational amplifier is electrically connected to the reference voltage, a first PMOS transistor having a source terminal electrically connected to the power supply voltage, and a gate terminal electrically connected to the single-ended output of the CMOS operational amplifier, a first resistor having a first terminal electrically connected to a drain terminal of the first PMOS transistor, and a second terminal electrically connected to the second input of the CMOS operational amplifier, a second resistor having a first terminal electrically connected to the second terminal of the first resistor, and a second terminal electrically connected to a ground reference voltage, and a second PMOS transistor having a source terminal electrically connected to the power supply voltage, a gate terminal electrically connected to the gate terminal of the first PMOS transistor, and a drain terminal electrically connected to the first branch of the current mirror.

2. The circuit of claim 1, wherein the output voltage is $$V_{OUT}=V_{REF}+(R_{FB}*I_{OUT}),$$

where $V_{OUT}$ is the output voltage, $V_{REF}$ is the reference voltage, $R_{FB}$ is the resistance of the feedback resistor, and $I_{OUT}$ is the output current.

3. The circuit of claim 1, wherein the output voltage is based on the mirror ratio of the current mirror, the mirror ratio being a ratio between a current flowing through the first branch and a current flowing through the second branch.

4. The circuit of claim 3, wherein one or more parameters of the first or second branch of the current mirror are adjustable, and wherein the adjusting of the one or more parameters changes the mirror ratio and the output voltage of the circuit.

5. The circuit of claim 3, wherein the current mirror includes:

a switch configured to adjust the mirror ratio of the current mirror, wherein opening the switch causes the current mirror to have a first mirror ratio, and wherein closing the switch causes the current mirror to have a second mirror ratio, the opening and closing of the switch causing the output voltage of the circuit to change.

6. The circuit of claim 1, wherein the first branch of the current mirror includes first one or more transistors, and wherein the second branch of the current mirror includes second one or more transistors, the mirror ratio being based on (i) physical dimensions of the transistors included in the first and second branches, and (ii) a number of transistors included in each of the first and second branches.

7. The circuit of claim 1, wherein the reference current varies based on process and temperature variation in the circuit, the second resistor has a resistance $R_{REF}$, the reference current is inversely proportional to the resistance $R_{REF}$, and the resistance $R_{REF}$ tracks changes in the resistance $R_{FB}$ of the feedback resistor, the resistance $R_{REF}$ increasing with increases in the resistance $R_{FB}$, and the resistance $R_{REF}$ decreasing with decreases in the resistance $R_{FB}$.

8. The circuit of claim 7, wherein the feedback resistor and the second resistor are formed of a same material on a single substrate, such that the feedback resistor and the second resistor have similar electrical properties under process, voltage, and temperature (PVT) variation.

9. The circuit of claim 1, wherein the reference current tracks changes in the resistance $R_{FB}$ of the feedback resistor, the reference current increasing with decreases in the resistance $R_{FB}$, and the reference current decreasing with increases in the resistance $R_{FB}$.

10. The circuit of claim 9, wherein the second resistor has a resistance $R_{REF}$, the reference current is inversely proportional to the resistance $R_{REF}$, the resistance $R_{REF}$ tracks the changes in the resistance $R_{FB}$ of the feedback resistor, the resistance $R_{REF}$ increasing with the increases in the resistance $R_{FB}$, and the resistance $R_{REF}$ decreasing with the decreases in the resistance $R_{FB}$, and the reference current tracks the changes in the resistance $R_{FB}$ based on changes in the resistance $R_{REF}$.

11. The circuit of claim 9, wherein the changes in the resistance $R_{FB}$ of the feedback resistor are a result of process, voltage, or temperature variation in the circuit.

12. The circuit of claim 11, wherein the output voltage of the circuit is $$V_{OUT}=V_{REF}|(R_{FB}*\alpha*I_{REF}),$$

where $V_{OUT}$ is the output voltage, $V_{REF}$ is the reference voltage, $\alpha$ is a constant based on the mirror ratio, and $I_{REF}$ is the reference current, wherein the reference current's tracking of the changes in the resistance $R_{FB}$ causes the output voltage to be substantially constant despite the process, voltage, or temperature variation in the circuit.

13. The circuit of claim 1, wherein the current source is a current-mode bandgap reference circuit.

14. The circuit of claim 1 comprising:

a voltage-mode bandgap reference circuit configured to generate the reference voltage.

15. The circuit of claim 1, wherein the first branch of the current mirror includes:

a first NMOS transistor having a drain terminal electrically connected to the current source, and a gate terminal electrically connected to a bias voltage, and a second NMOS transistor having a drain terminal electrically connected to a source terminal of the first NMOS transistor, and a source terminal electrically connected to a ground reference voltage;

wherein the second branch of the current mirror includes:

a third NMOS transistor having a drain terminal electrically connected to the second terminal of the feedback resistor, and a gate terminal electrically connected to the bias voltage, a fourth NMOS transistor having a drain terminal electrically connected to a source terminal of the third NMOS transistor, a gate terminal electrically connected to a gate terminal of the second NMOS transistor, and a source terminal electrically connected to the ground reference voltage, a fifth NMOS transistor having a drain terminal electrically connected to the second terminal of the feedback resistor, and a gate terminal electrically connected to the bias voltage, and a sixth NMOS transistor having a drain terminal electrically connected to a source terminal of the fifth NMOS transistor, a gate terminal electrically connected to the gate terminal of the second NMOS transistor, and a source terminal electrically connected to the ground reference voltage via a switch.

16. A circuit for generating an output voltage that is substantially constant despite process, voltage, or temperature variation in the circuit, the circuit comprising:

an error amplifier having a first input, a second input, and a single-ended output, wherein the first input is electrically connected to a reference voltage, and the second input is electrically connected to an output node of the circuit via a feedback resistor, the feedback resistor including a first terminal electrically connected to the output node and a second terminal electrically connected to the second input;

a pass transistor including a control electrode electrically connected to the single-ended output of the error amplifier, a first electrode electrically connected to the power supply voltage, and a second electrode electrically connected to the output node of the circuit;

a current source configured to generate a reference current that changes when a resistance of the feedback resistor changes;

a current mirror including:

a first NMOS transistor including a source terminal electrically connected to a ground reference voltage, a gate terminal electrically connected to a drain terminal of the first NMOS transistor, and the drain terminal electrically connected to the current-mode bandgap reference circuit, wherein the reference current flows between the drain and source terminals of the first NMOS transistor, and a second NMOS transistor including a source terminal electrically connected to the ground reference voltage, a gate terminal electrically connected to the gate terminal of the first NMOS transistor, and a drain terminal electrically connected to the second terminal of the feedback resistor, wherein an output current that flows between the drain and source terminals of the second NMOS transistor is based on the reference current and a mirror ratio of the current mirror, wherein the output node provides an output voltage of the circuit, and the current source includes:

a complementary metal-oxide-semiconductor (CMOS) operational amplifier including a first input, a second input, and a single-ended output, wherein the first input of the CMOS operational amplifier is electrically connected to the reference voltage, a first PMOS transistor having a source terminal electrically connected to the power supply voltage, and a gate terminal electrically connected to the single-ended output of the CMOS operational amplifier, a first resistor having a first terminal electrically connected to a drain terminal of the first PMOS transistor, and a second terminal electrically connected to the second input of the CMOS operational amplifier, a second resistor having a first terminal electrically connected to the second terminal of the first resistor, and a second terminal electrically connected to a ground reference voltage, and a second PMOS transistor having a source terminal electrically connected to the power supply voltage, a gate terminal electrically connected to the gate terminal of the first PMOS transistor, and a drain terminal electrically connected to the first branch of the current mirror.

17. The circuit of claim 1, wherein as the resistance of the feedback resistor increases, the reference current decreases a corresponding amount that causes the output voltage to be substantially constant.

18. The circuit of claim 1, wherein the output voltage is substantially constant despite process, voltage, or temperature variation in the circuit.

19. The circuit of claim 16, wherein as the resistance of the feedback resistor increases, the reference current decreases a corresponding amount that causes the output voltage to be substantially constant.

20. A circuit for generating an output voltage that is substantially constant despite process, voltage, or temperature variation in the circuit, the circuit comprising:

an error amplifier having a first input, a second input, and an output, wherein the first input is electrically connected to a reference voltage, and the second input is electrically connected to an output node of the circuit via a feedback resistor, the feedback resistor including a first terminal electrically connected to the output node and a second terminal electrically connected to the second input;

a pass transistor including a control electrode electrically connected to the output of the error amplifier, a first electrode electrically connected to a power supply voltage, and a second electrode electrically connected to the output node of the circuit;

a current source configured to generate a reference current that changes when a resistance of the feedback resistor changes;

a first branch of a current mirror electrically connected to the current source, the reference current flowing through the first branch; and a second branch of the current mirror electrically connected to the second terminal of the feedback resistor, wherein an output current that flows through the second branch and between the first and second terminals of the feedback resistor is based on (i) the reference current flowing through the first branch, and (ii) a mirror ratio of the current mirror, wherein the output node provides an output voltage of the circuit, and the current source includes:

an operational amplifier including a first input, a second input, and a single-ended output, wherein the first input of the operational amplifier is electrically connected to the reference voltage, a first PMOS transistor having a source terminal electrically connected to the power supply voltage, and a gate terminal electrically connected to the single-ended output of the operational amplifier, a first resistor having a first terminal electrically connected to a drain terminal of the first PMOS transistor, and a second terminal electrically connected to the second input of the operational amplifier, a second resistor having a first terminal electrically connected to the second terminal of the first resistor, and a second terminal electrically connected to a ground reference voltage, and a second PMOS transistor having a source terminal electrically connected to the power supply voltage, a gate terminal electrically connected to the gate terminal of the first PMOS transistor, and a drain terminal electrically connected to the first branch of the current mirror.

* * * * *